US008534257B2

(12) United States Patent
Ogi et al.

(10) Patent No.: US 8,534,257 B2
(45) Date of Patent: Sep. 17, 2013

(54) ENGINE CASE

(75) Inventors: Taiichiro Ogi, Tokyo (JP); Hiroki Bessho, Sakai (JP); Masatake Murakawa, Osaka (JP)

(73) Assignees: Fuji Jukogyo Kabushiki Kaisha, Tokyo (JP); Kubota Corporation, Osaka (JP)

( * ) Notice: Subject to any disclaimer, the term of this patent is extended or adjusted under 35 U.S.C. 154(b) by 438 days.

(21) Appl. No.: 12/870,942

(22) Filed: Aug. 30, 2010

(65) Prior Publication Data

US 2011/0155093 A1 Jun. 30, 2011

(30) Foreign Application Priority Data

Dec. 25, 2009 (JP) ..... 2009-295742

(51) Int. Cl.
*F01M 1/02* (2006.01)

(52) U.S. Cl.
USPC ..... 123/195 R; 123/196 R

(58) Field of Classification Search
USPC ..... 123/195 R, 196 R; 184/6.5, 103.1
See application file for complete search history.

(56) References Cited

U.S. PATENT DOCUMENTS

| | | | | |
|---|---|---|---|---|
| 2002/0011230 | A1 | 1/2002 | Furuya | |
| 2002/0112691 | A1 | 8/2002 | Furuya et al. | |
| 2003/0079710 | A1 * | 5/2003 | Webster et al. | 123/196 R |

FOREIGN PATENT DOCUMENTS

| | | | |
|---|---|---|---|
| JP | 11115517 | A | 4/1999 |
| JP | 11350932 | A | 12/1999 |
| JP | 200530304 | A | 2/2005 |
| JP | 3781945 | B2 | 3/2006 |
| JP | 2006105132 | A | 4/2006 |
| JP | 2006266127 | A | 10/2006 |
| JP | 2006283567 | A | 10/2006 |
| JP | 3943340 | B2 | 4/2007 |

* cited by examiner

*Primary Examiner* — Noah Kamen
(74) *Attorney, Agent, or Firm* — The Webb Law Firm

(57) ABSTRACT

An engine case includes: a crank chamber (2R) of an engine (1); a clutch chamber (30R) having a wet clutch (30) connected to an output shaft (2) protruding from the crank chamber (2R); a partition wall (10) keeping the crank and clutch chambers separated and connecting the crank and clutch chambers; an oil inlet (11) for introducing engine oil; an oil feeding passage (11R) which is configured to allow the engine oil introduced from the oil inlet (11) to first enter the clutch chamber (30R) separated by the partition wall (10); and an inflow part (10h) which is formed in the partition wall (10) and configured to allow an excess amount of the introduced engine oil over a predetermined amount to flow into the crank chamber (2R).

12 Claims, 5 Drawing Sheets

ENGINE CASE

BACKGROUND

1. Field of the Invention

The present invention relates to an engine case including: a crank chamber of an engine; a clutch chamber having a wet clutch connected to an output shaft protruding from the crank chamber; and a partition wall keeping the crank and clutch chambers separated and connecting the crank and clutch chambers.

2. Description of the Related Art

For prior art techniques relating to this type of engine case, there can be mentioned Japanese Unexamined Patent Application Publication No. 11-115517 (see paragraphs [0042]-[0044] and FIG. 5). The engine case described in this patent document has a first partition wall at least partially separating a crank chamber from a wet clutch, and a second partition wall separating the wet clutch from a V-belt continuously variable transmission. Engine oil stored in the crank chamber is sent by an oil pump, and supplied to a clutch chamber through a radial oil passage formed inside the second partition wall and an axial oil passage formed in the crankshaft (output shaft), to thereby lubricate various portions of the wet clutch. Through a portion near a lower end of the first partition wall, a communicating passage penetrates that communicates the crank chamber with the clutch chamber, and superfluous engine oil discharged from the wet clutch is allowed to return to the crank chamber through the communicating passage. It should be noted that the above-described patent document does not specifically describe where the oil inlet for engine oil should be located, but from the viewpoint of the general technique, it is presumed that the oil inlet is located in a portion of an outer wall of the crank chamber.

However, in the engine case described in the above-described patent document, it is necessary to form oil passages inside the crankshaft that extend in axial and radial directions and to secure an oil passage between an output shaft of the wet clutch and an input shaft of the transmission mechanism. Accordingly, remarkably high processing accuracy has been required.

In addition, in the case of the engine case described in the above-described patent document, at an early stage of starting of the engine after feeding the engine oil from the oil inlet, the engine oil is distributed in the crank chamber while the engine oil is not yet distributed over various portions in the clutch chamber. Since the engine is operated under this condition, the clutch should be in an off-state to perform a pre-conditioning interim operation that does not burden the engine, until a sufficient amount of the engine oil is distributed over the various portions in the clutch chamber.

SUMMARY OF THE INVENTION

In view of the problems of the prior art technique described above, it is desirable to provide an engine case that can smoothly supply the engine oil to the wet clutch, without requiring high processing accuracy.

In addition, it is also desirable to provide an engine case which allows the operation of the engine in a loaded state even at the relatively early stage of starting of the engine after feeding a predetermined small amount of the engine oil.

Accordingly, in an aspect of the present invention, there is provided an engine case including: a crank chamber of an engine; a clutch chamber having a wet clutch connected to an output shaft protruding from the crank chamber; a partition wall keeping the crank and clutch chambers separated and connecting the crank and clutch chambers; an oil inlet for introducing engine oil; an oil feeding passage which is configured to allow the engine oil introduced from the oil inlet to first enter the clutch chamber separated by the partition wall; and an inflow part which is formed in the partition wall and configured to allow an excess amount of the introduced engine oil over a predetermined amount to flow into the crank chamber.

In the engine case described above, it is preferable that a bottom portion of the clutch chamber is provided with a drain hole.

In the engine case described above, it is also preferable that a height level of the inflow part is higher than a height level of the output shaft, when the engine is mounted on a vehicle.

In the engine case described above, it is preferable that the partition wall serves as a bearing case pivotally supporting the output shaft, and an oil pump configured to suck the engine oil stored in the crank chamber and supply the sucked engine oil to the clutch chamber is provided on a face of the partition wall on a crank chamber side.

In the engine case described above, it is preferable that the partition wall is provided with an oil supply pathway configured to distribute the engine oil sent from the oil pump to portions including the clutch chamber and the crank chamber at a predetermined ratio.

In the engine case described above, it is preferable that a level gauge insertion opening and the oil inlet for engine oil are disposed on an outer periphery of the partition wall.

In the engine case described above, it is preferable that he oil supply pathway is provided with an oil filter.

In the engine case described above, it is preferable that the engine oil is distributed at the predetermined ratio by openings provided in the oil supply pathway, the openings being oriented to respective portions.

In the engine case described above, it is preferable that a height level of the opening is higher than a height level of the inflow part, when the engine is mounted on a vehicle.

BRIEF DESCRIPTION OF THE DRAWINGS

The various aspects, other advantages and further features of the present invention will become more apparent by describing in detail illustrative, non-limiting embodiments thereof with reference to the accompanying drawings.

DETAILED DESCRIPTION OF THE PREFERRED EMBODIMENTS

Hereinbelow, embodiments of the present invention will be described with reference to the drawings.

Figure 1:
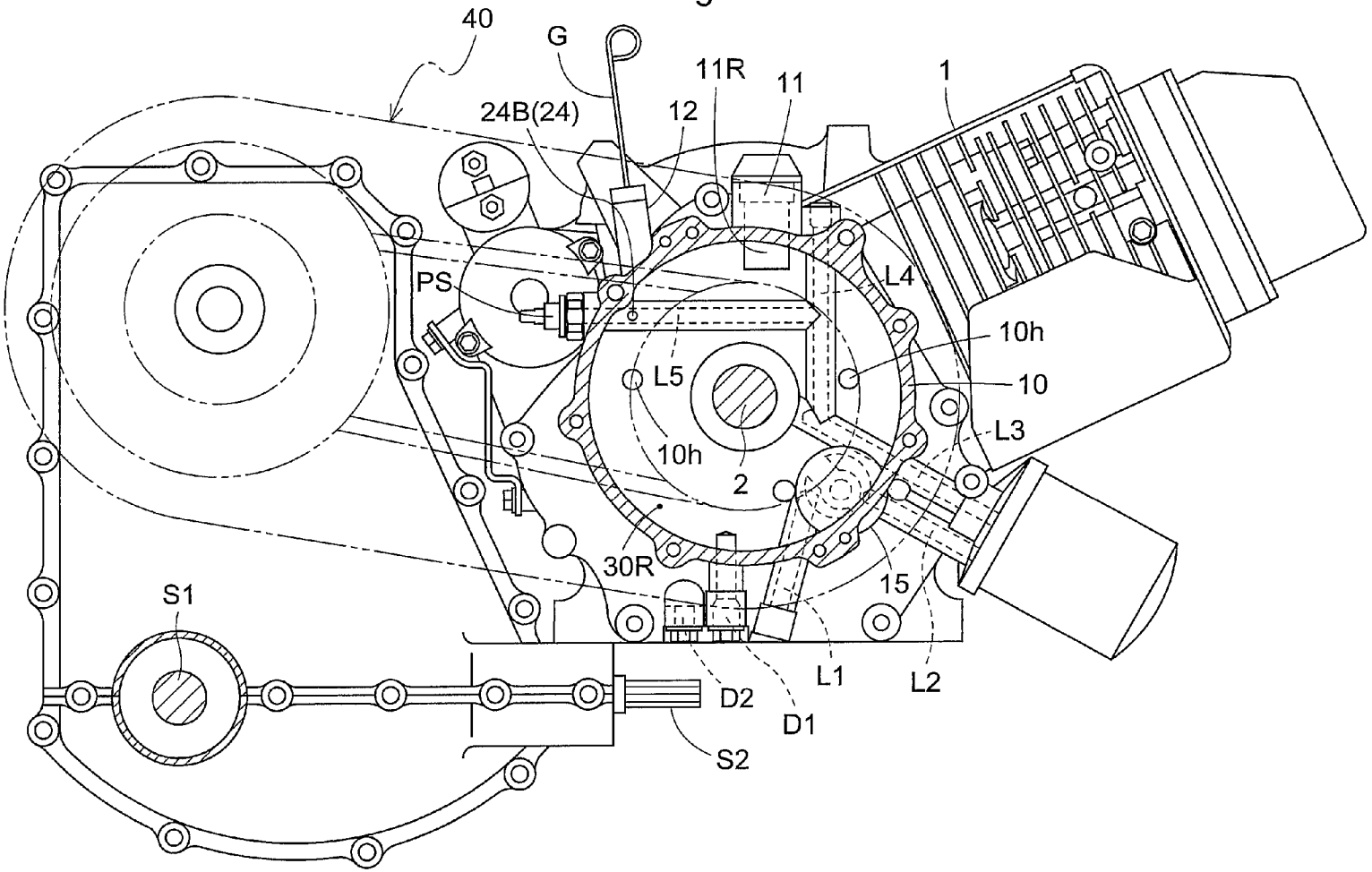
FIG. 1 is a partially cutaway side view showing an engine case according to the present invention.

FIG. 1 shows an OHC type engine 1 having a single cylinder, and a belt-type continuously variable transmission 40 connected to a crankshaft 2 (one example of an output shaft) of the engine 1.

Figure 2:
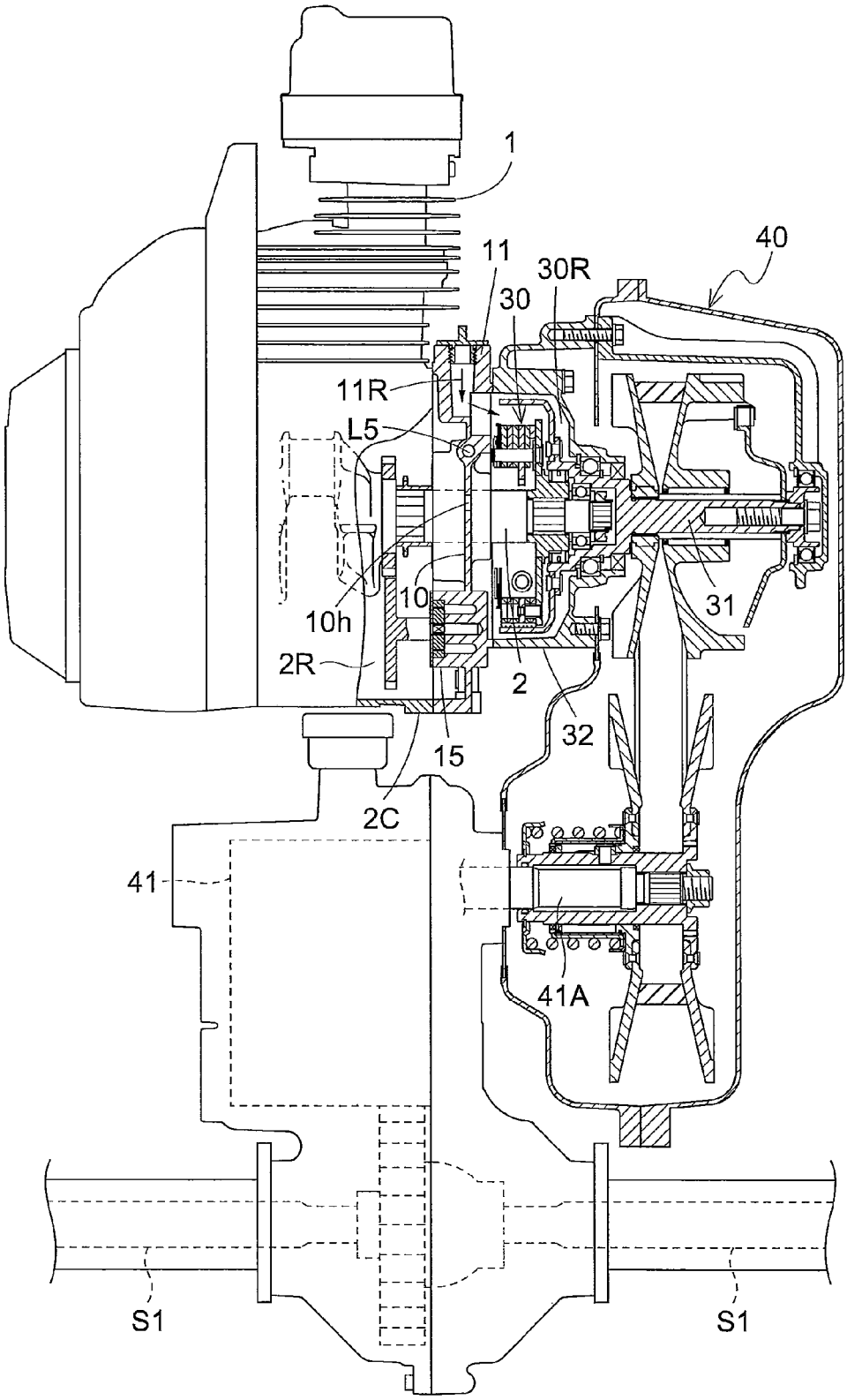
FIG. 2 is a partially cutaway front view of the engine case of FIG. 1.

As shown in FIG. 2, between the crankshaft 2 of the engine 1 and the belt-type continuously variable transmission 40, a centrifugal wet clutch 30 is disposed which is configured to transmit a rotary driving force of the crankshaft 2 to a downstream side, based on a centrifugal force increased in accordance with a rotational speed of the crankshaft 2. It should be noted that a friction multiple disc clutch may be used, instead of the centrifugal wet clutch 30.

A transmission mechanism connected to the centrifugal wet clutch 30 is made up of the belt-type continuously variable transmission 40 connected to an output shaft 31 of the centrifugal wet clutch 30 and an auxiliary transmission mechanism 41 connected to an output shaft 41A of the belt-type continuously variable transmission 40. The auxiliary transmission mechanism 41 includes a forward-reverse switching mechanism (not shown) and an auxiliary speed change mechanism (not shown), and from the auxiliary transmission mechanism 41, an output shaft Si for rear wheel and an output shaft S2 for front wheel extend.

Between the centrifugal wet clutch 30 and the engine 1, a bearing case 10 (one example of the partition wall) is disposed which is configured to rotatably support an output side of the crankshaft 2. The bearing case 10 is fastened to a crankcase 2C of the engine 1 and encloses a crank chamber 2R, to thereby make up a partition wall configured to separate the crank chamber 2R from the centrifugal wet clutch 30. The centrifugal wet clutch 30 is connected to the crankshaft 2 (one example of the output shaft) protruding from the crank chamber 2R.

On an outside of the bearing case 10, a clutch case 32 into which the output shaft 31 of the centrifugal wet clutch 30 is inserted is hermetically attached, and between the bearing case 10 and the clutch case 32, a clutch chamber 30R configured to encase the centrifugal wet clutch 30 is formed.

An oil inlet 11 and a level gauge insertion opening 12 for engine oil are disposed on an outer periphery of an upper portion of the bearing case 10, not on the crankcase 2C of the engine 1.

With this configuration, the level gauge insertion opening 12 and the oil inlet 11 can be arranged at approximately the same position along the crankshaft 2 (output shaft 31), and thus checking of a contamination level of the engine oil, feeding of the engine oil, maintenance of the wet clutch unit, and the like, can be easily performed.

The crankcase 2C, the bearing case 10 (partition wall), and the clutch case 32 collectively make up the engine case according to the present invention.

Figure 3:
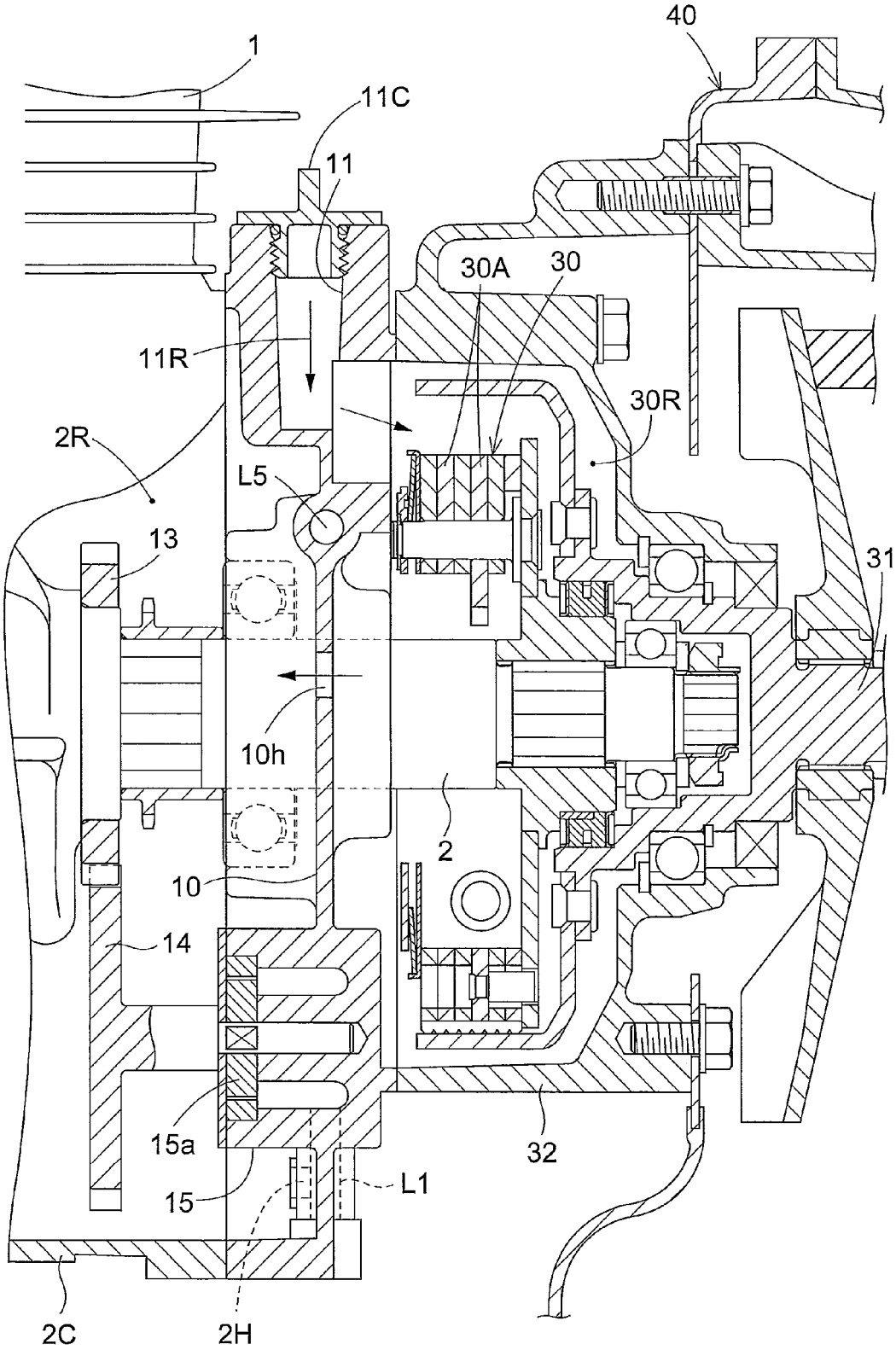
FIG. 3 is a cutaway front view showing a portion around a partition wall (bearing case) and a wet clutch.

In this case, as shown in FIGS. 2 and 3, the bearing case 10 (partition wall) serves as a wall on a right side (in the drawing) of the crank chamber 2R, and at the same time, serves as a wall on a left side (in the drawing) of the clutch chamber 30R. With this configuration, when the bearing case 10 (partition wall) is detached from the crankcase 2C and the bearing case 10 (partition wall) is detached from the clutch case 32, the right side (in the drawing) of the crank chamber 2R is opened, and the left side (in the drawing) of the clutch chamber 30R is opened.

A level gauge G inserted from the level gauge insertion opening 12 is guided linearly and obliquely downward toward a bottom area of the crank chamber 2R.

On the other hand, as shown in FIGS. 2 and 3, an oil feeding passage 11R for guiding the engine oil is bent outward of the crank chamber 2R in a lower portion of the oil inlet 11 so that the engine oil fed from the oil inlet 11 exposed by removing an oil filler cap 11C first fills the clutch chamber 30R, instead of going to the crank chamber 2R.

Figure 4:
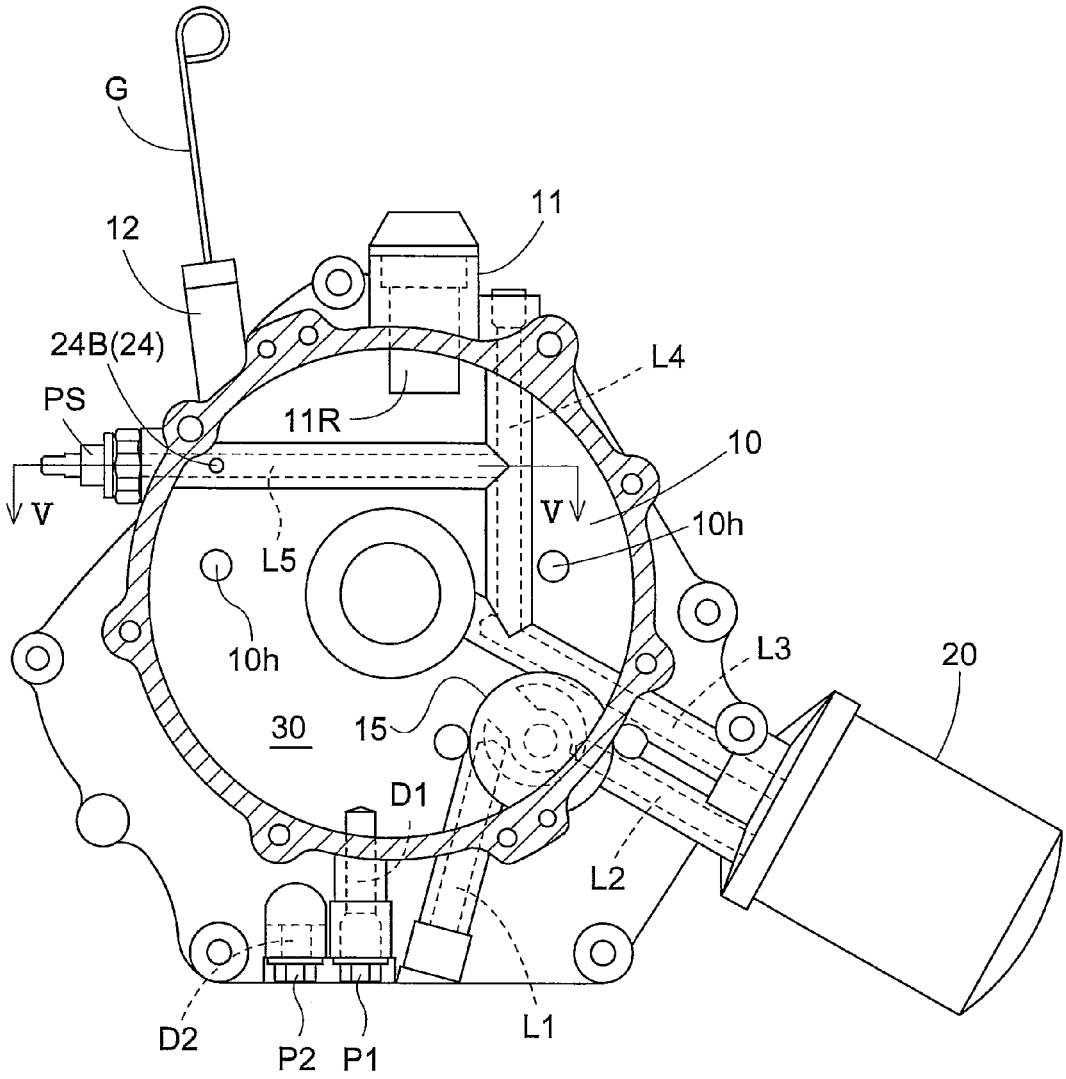
FIG. 4 is a partially cutaway side view (one side) showing the partition wall (bearing case).

As shown in FIGS. 2-4, at a height level slightly above that of the crankshaft 2 in the bearing case 10, two oil holes 10*h* (one example of the inflow part) are formed. When the engine oil in an amount appropriate for the centrifugal wet clutch 30 is introduced from the oil inlet 11, a liquid level of the engine oil gradually increases in the clutch chamber 30R. When the liquid level of the engine oil reaches the oil holes 10*h*, it means that the clutch chamber 30R is filled with an appropriate amount (predetermined amount) of the engine oil. When the introduction of the engine oil is continued, the engine oil overflows from the oil holes 10*h* and begins to flow into the crank chamber 2R on the left side in FIG. 3. In this manner, there is no need to provide an oil passage between, for example, the output shaft 31 of the wet clutch 30 and the input shaft of the transmission mechanism, and thus the engine case can be obtained at a lower cost whose assembly is facilitated. It should be noted that, in the case described above, the oil holes 10*h* are positioned at a height level slightly above that of the crankshaft 2. However, the height level is not limited to this, and alternatively, the oil holes 10*h* may be formed at a height level approximately the same as that of the crankshaft 2, or may be formed at a height level slightly below that of the crankshaft 2.

Accordingly, since a sufficient amount of the engine oil is always secured in the clutch chamber 30R having the wet clutch 30, even at the early stage of starting of the engine 1 after feeding the engine oil from the oil inlet 11, such as immediately after the assembling of the engine where no engine oil is present in both the crank chamber 2R and the clutch chamber 30R, the immediate operation of the engine 1 in a loaded state becomes possible.

As shown in FIGS. 3 and 4, on a lower portion of a face of the bearing case 10 on a crank chamber 2R side, an oil pump 15 of a trochoidal type is mounted. The oil pump 15 is configured to suck in the engine oil stored in the crank chamber 2R, and spray the engine oil toward an upper area in the crank chamber 2R, portions of a clutch plate 30A positioned higher than the oil hole 10*h* in the centrifugal wet clutch 30, and the like. A rotor 15*a* of the oil pump 15 is driven by a rotary driving force of the crankshaft 2. In other words, as shown in FIG. 3, an output gear 13 is fixed to a portion of the crankshaft 2, and an input gear 14 which is always engaged with the output gear 13 is configured to be rotated with the rotor 15*a* in a unified manner.

With this configuration, as compared with the case where the oil pump 15 is provided on a face of the partition wall on a clutch chamber 30R side, the wet clutch 30 can be arranged closer to the bearing case 10, and thus the reduction in the size of the wet clutch unit can be facilitated. In addition, since the oil pump 15 is not present on the clutch chamber 30R side of the bearing case 10, which may otherwise be arranged on the clutch chamber 30R so as not to hinder the wet clutch 30, the clutch case 32 closing the clutch chamber 30R can have basically a simple shape, such as a disc enclosing only the wet clutch 30.

In addition, a cartridge type oil filter 20 configured to filter the engine oil may be attached to a portion of an outer periphery of the bearing case 10. The engine oil sent out from the oil pump 15 is filtered by a filter element in the oil filter 20, and then sent to the crank chamber 2R or the clutch chamber 30R.

Figure 6:
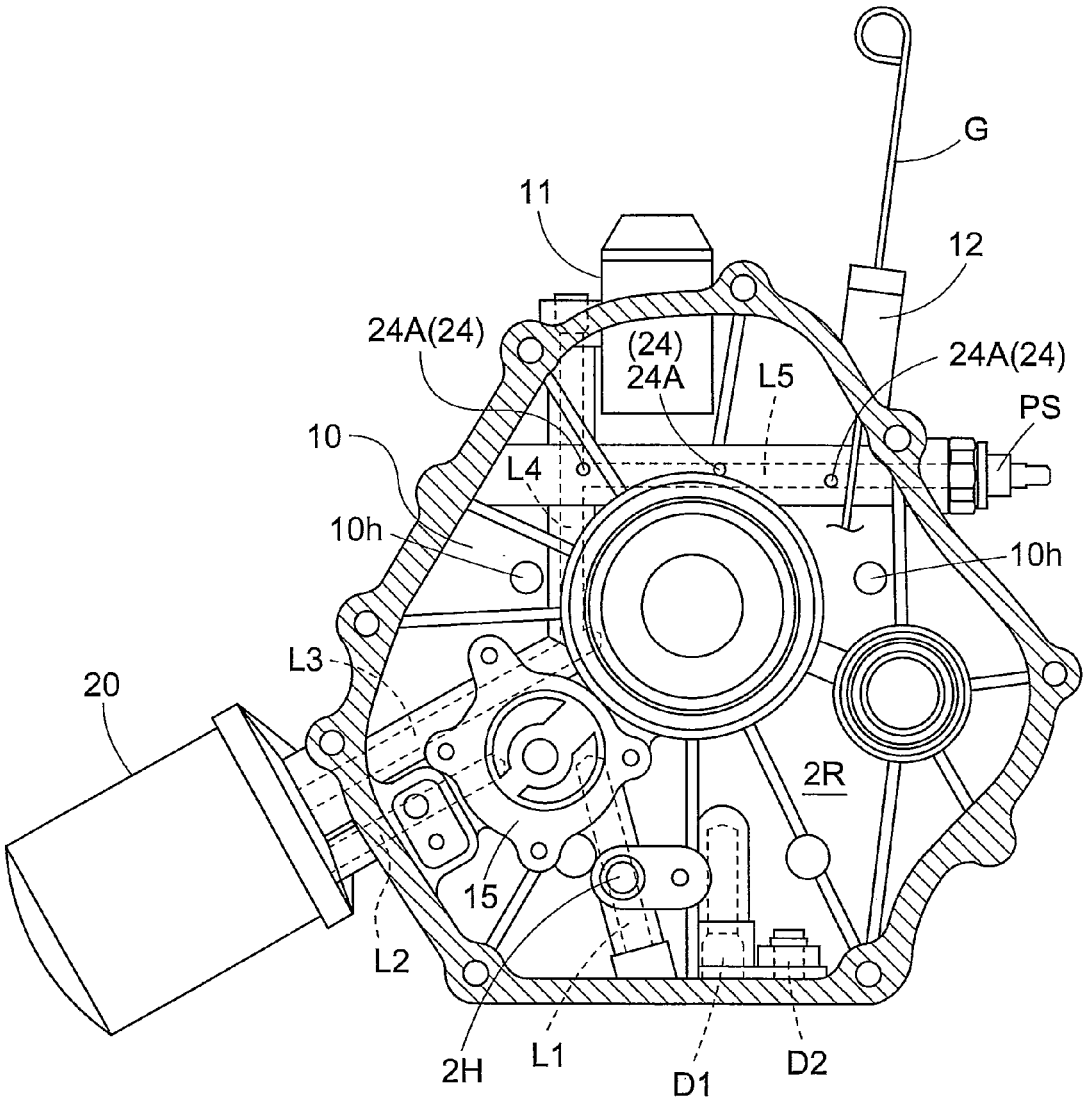
FIG. 6 is a partially cutaway side view (the other side) showing the partition wall (bearing case).

In the bearing case 10, there are provided: a first oil passage L1 extending obliquely upward so as to send the engine oil, sucked from an oil suction hole 2H (see FIG. 6) formed above the bottom portion of the crank chamber 2R, to the oil pump 15; a second oil passage L2 extending obliquely downward so as to send the engine oil from the oil pump 15 to an inlet of the oil filter 20; a third oil passage L3 extending obliquely upward from an outlet of the oil filter 20 toward the crankshaft 2; a fourth oil passage L4 extending right above from an end portion of the third oil passage L3 to above the oil hole 10*h;* and a fifth oil passage L5 extending horizontally from a portion of the fourth oil passage L4. It should be noted that various modifications are possible with respect to the extending directions of the oil passages. For example, the first oil passage L1 may extend vertically upward, instead of extending obliquely upward.

Figure 5:
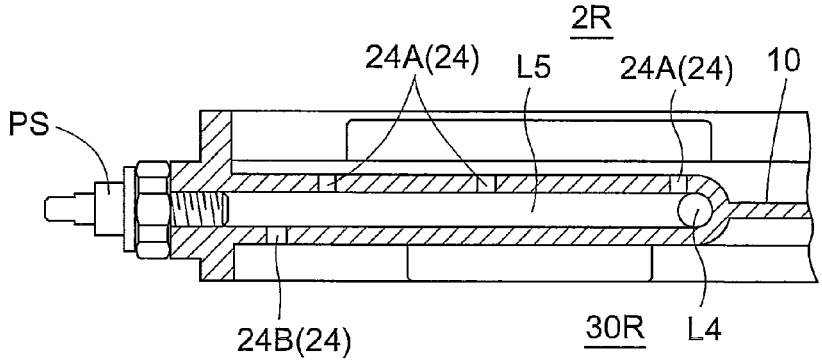
FIG. 5 is a cutaway plan view of a fifth oil passage along a line V-V of FIG. 4.

On both sides of the fifth oil passage L5, a plurality of small oil discharge holes 24 are formed. As shown in FIG. 5, the oil discharge holes 24 include three oil discharge holes 24A opened toward the crank chamber 2R, and a single oil discharge hole 24B opened toward the clutch chamber 30R (see also FIG. 6). Four oil discharge holes 24 in total have a function of distributing the engine oil to the crank chamber 2R and the clutch chamber 30R at a predetermined ratio (e.g., approximately 3 to 1). Of course, the engine oil may be distributed to a camshaft (not shown) of an intake valve (not shown) or an exhaust valve (not shown) of the engine 1, in addition to the crank chamber 2R and the clutch chamber 30R. It should be noted that the number of the oil discharge hole 24 and the oil discharge hole 24B are not limited to the number described above.

To an end portion of the fifth oil passage L5, a pressure sensor PS configured to detect a pressure of the engine oil is attached.

With the configuration described above, along an inside of the partition wall (bearing case 10) having an approximate plate shape, an oil supply pathway can be easily provided.

On a lower face of the bearing case 10, a first drain hole Dl through which the engine oil in the clutch chamber 30R can be discharged and a second drain hole D2 through which the engine oil in the crank chamber 2R can be discharged are separately and adjacently provided along a circumferential direction, in such a manner that they can be closed or opened by attachment or removal of closing plugs P1 and P2, respectively. With this configuration, while retaining the engine oil in the crank chamber 2R, the engine oil in the clutch chamber 30R can be drained, so that the checking of the wet clutch 30, the exchange of the engine oil and the like can be performed.

It should be noted that, in the above-described embodiment, two oil holes 10*h* are formed in the bearing case 10. Alternatively, the inflow part may be, for example, a half-moon-shaped opening, which is defined by a straight line chord connecting the two oil holes 10*h* and an upward extending arc connecting the two oil holes 10*h* with the crankshaft 2 as a center.

In addition, the present invention may be applicable to an OHV type engine, whose camshaft (one example of the output shaft, not shown) of the engine 1 is connected to the wet clutch.

Accordingly, with respect to an engine case including a crank chamber of an engine, a clutch chamber having a wet clutch connected to an output shaft protruding from the crank chamber, and a partition wall keeping the crank and clutch chambers separated and connecting the crank and clutch chambers, the present invention provides a technique for reasonably arranging an oil inlet for engine oil and oil feeding passages guiding the introduced engine oil.

What is claimed is:

1. An engine case comprising:

a crank chamber of an engine;

a clutch chamber having a wet clutch connected to an output shaft protruding from the crank chamber;

a partition wall keeping the crank and clutch chambers separated and connecting the crank and clutch chambers;

an oil inlet for introducing engine oil;

an oil feeding passage which is configured to allow the engine oil introduced from the oil inlet to first enter the clutch chamber separated by the partition wall; and an inflow part which is formed in the partition wall and configured to allow an excess amount of the introduced engine oil over a predetermined amount to flow into the crank chamber;

wherein a height level of the inflow part is higher than a height level of the output shaft, when the engine is mounted on a vehicle.

2. The engine case according to claim 1, wherein a bottom portion of the clutch chamber is provided with a drain hole.

3. The engine case according to claim 1, wherein the partition wall serves as a bearing case pivotally supporting the output shaft, and an oil pump configured to suck the engine oil stored in the crank chamber and supply the sucked engine oil to the clutch chamber is provided on a face of the partition wall on a crank chamber side.

4. The engine case according to claim 3, wherein a level gauge insertion opening and the oil inlet for engine oil are disposed on an outer periphery of the partition wall.

5. The engine case according to claim 3, wherein the partition wall is provided with an oil supply pathway configured to distribute the engine oil sent from the oil pump to portions including the clutch chamber and the crank chamber at a predetermined ratio.

6. The engine case according to claim 5, wherein the oil supply pathway is provided with an oil filter.

7. The engine case according to claim 5, wherein the engine oil is distributed at the predetermined ratio by openings provided in the oil supply pathway, the openings being oriented to the respective portions.

8. The engine case according to claim 7, wherein a height level of the opening is higher than a height level of the inflow part, when the engine is mounted on a vehicle.

9. An engine case comprising:

a crank chamber of an engine;

a clutch chamber having a wet clutch connected to an output shaft protruding from the crank chamber;

a partition wall keeping the crank and clutch chambers separated and connecting the crank and clutch chambers;

an oil inlet for introducing engine oil;

an oil feeding passage which is configured to allow the engine oil introduced from the oil inlet to first enter the clutch chamber separated by the partition wall;

an inflow part which is formed in the partition wall and configured to allow an excess amount of the introduced engine oil over a predetermined amount to flow into the crank chamber; and an oil pump configured to suck the engine oil and supply the sucked engine oil;

wherein the oil pump is provided on the partition wall.

10. The engine case according to claim 9, wherein the partition wall serves as a bearing case pivotally supporting the output shaft, and the oil pump is provided on a face of the partition wall on a crank chamber side, the oil pump being configured to suck the engine oil stored in the crank chamber and supply the sucked engine oil to the clutch chamber.

11. An engine case comprising:

a crank chamber of an engine;

a clutch chamber having a wet clutch connected to an output shaft protruding from the crank chamber;

a partition wall keeping the crank and clutch chambers separated and connecting the crank and clutch chambers;

an oil inlet for introducing engine oil;

an oil feeding passage which is configured to allow the engine oil introduced from the oil inlet to first enter the clutch chamber separated by the partition wall; and an inflow part which is formed in the partition wall and configured to allow an excess amount of the introduced engine oil over a predetermined amount to flow into the crank chamber, wherein the partition wall is detachably provided and the oil inlet is formed in the partition wall.

12. The engine case according to claim 11, wherein a first drain hole and a second drain hole are formed in the partition wall, and wherein the engine oil in the clutch chamber can be discharged through the first drain hole and the engine oil in the crank chamber can be discharged through the second drain hole.

* * * * *